US007857038B2

(12) United States Patent
Kim et al.

(10) Patent No.: US 7,857,038 B2
(45) Date of Patent: Dec. 28, 2010

(54) HEAT EXCHANGER

(75) Inventors: Kihong Kim, Daejeon-si (KR); Jungjae Lee, Daejeon-si (KR); Youngha Jeon, Daejeon-si (KR)

(73) Assignee: Halla Climate Control Corporation, Daejeon-Si (KR)

( * ) Notice: Subject to any disclaimer, the term of this patent is extended or adjusted under 35 U.S.C. 154(b) by 274 days.

(21) Appl. No.: 11/786,257

(22) Filed: Apr. 11, 2007

(65) Prior Publication Data

US 2007/0240863 A1 Oct. 18, 2007

(30) Foreign Application Priority Data

Apr. 14, 2006 (KR) ..... 10-2006-0033981

(51) Int. Cl.
*F28D 1/00* (2006.01)

(52) U.S. Cl. ..... 165/149

(58) Field of Classification Search ..... 165/149
See application file for complete search history.

(56) References Cited

U.S. PATENT DOCUMENTS

| | | | | | |
|---|---|---|---|---|---|
| 1,906,969 | A | * | 5/1933 | Ihde | 165/149 |
| 2,545,561 | A | * | 3/1951 | Spieth | 165/151 |
| 2,932,489 | A | * | 4/1960 | Young | 165/149 |
| 3,165,151 | A | * | 1/1965 | Astrup et al. | 165/149 |
| 3,228,461 | A | * | 1/1966 | Seekins | 165/152 |
| 5,667,004 | A | * | 9/1997 | Kroetsch | 165/149 |
| 6,006,430 | A | * | 12/1999 | Fukuoka et al. | 165/149 |
| 6,179,050 | B1 | * | 1/2001 | Dey et al. | 165/149 |
| 2007/0204983 | A1 | * | 9/2007 | Ichiyanagi | 165/176 |

FOREIGN PATENT DOCUMENTS

| | | | | |
|---|---|---|---|---|
| JP | 3-225197 | * | 10/1991 | 165/149 |

* cited by examiner

*Primary Examiner*—Teresa J Walberg
(74) *Attorney, Agent, or Firm*—Fulbright & Jaworski L.L.P.

(57) ABSTRACT

The present invention relates to a heat exchanger which has approximately U-shaped ribs formed on both sides of a body of a side support, thereby preventing a deterioration of heat exchange capacity by reinforcing strength and securing bonding areas of sealing members and stably supporting radiation fins since the ribs press edges of the radiation fins.

6 Claims, 6 Drawing Sheets

Prior Art

HEAT EXCHANGER

This application claims priority from Korean Patent Application No. 10-2006-0033981 filed Apr. 14, 2006, incorporated herein by reference in its entirety.

BACKGROUND OF THE INVENTION

1. Field of the Invention

The present invention relates to a heat exchanger, and more particularly, to a heat exchanger which has approximately U-shaped ribs formed on both sides of a body of a side support, thereby preventing a deterioration of heat exchange capacity by reinforcing strength and securing bonding areas of sealing members and stably supporting radiation fins since the ribs press edges of the radiation fins.

2. Background Art

In general, a heat exchanger used in an air conditioner for a vehicle is installed on a flow channel of heat exchange medium of a cooling and heating system and performs heat exchange in such a manner that the heat exchanger medium flowing inside the heat exchanger sucks the outside heat or emits heat to the outside to thereby heat or cool a predetermined space.

An evaporator, a heater core, a condenser, a radiator and so on belong to the heat exchanger. The evaporator and the heater core are selectively installed in an air-conditioning case for heating and cooling the inside of the vehicle by heat-exchanging the air sent from an air blast.

FIG. 1 illustrates an example of the heater core of such a heat exchanger 1. In FIG. 1, the heater core includes: a pair of header tanks 2 and 3 spaced apart from each other by a predetermined interval and arranged at upper and lower parts in parallel to each other; a plurality of tubes 4 combined to both ends of the header tanks in such a way as to fluidically communicate with the header tanks; radiation fins 5 interposed between the tubes 4; and a pair of side supports 6 mounted at the outermost portions of the tubes 4 and the radiation fins 5 to reinforce the tubes 4 and the radiation fins 5.

In addition, both ends of the upper and lower header tanks 2 and 3 are sealed by end caps 9, and inlet and outlet pipes 7 and 8 are mounted on the header tanks 2 and 3 for introducing and discharging the heat exchange medium.

Therefore, the heat exchange medium is introduced into the header tank 2 through the inlet pipe 7, introduced into the other header tank 3 while flowing along the tubes 4, and then, discharged through the outlet pipe 8.

Here, the heat exchanger medium transfers heat to the radiation fins 5 while flowing in the tubes 4, and then is cooled while actively performing heat exchange with the outside air.

In the meantime, on a part of the heat exchanger 1 which is in contact with the inner wall surface of an air-conditioning case (not shown), bonded are sealing members 10 to prevent a leakage of air flowing inside the air-conditioning case when the heat exchanger 1 is received to the inside of the air-conditioning case.

Particularly, the sealing members 10 are bonded on both sides of the side supports 6. However, it is difficult to bond the sealing members 10 on the side supports 6, since the structure of the conventional side support 6 is difficult to secure a bonding area of the sealing member 10 on both sides thereof and the side supports 6 are mounted in such a way as to form a tiered portion together with end portions of the header tanks 2 and 3.

When the sealing members 10 are bonded on the both sides of the side supports 6 in a state where the bonding area for the sealing member 10 is not secured, the sealing members 10 invade an area of the radiation fins 5 and hide the radiation fins 5, and thereby, the heat exchange capacity is decreased.

The side support 6 is generally manufactured by a roll-forming process. In this instance, the side support 6 has inserted portions (not shown) protrudingly formed on both ends thereof to be inserted/combined to the header tank, and so, is weak to impact since it is difficult to form a reinforcing rib (a curved form) along a longitudinal center of the side support 6.

SUMMARY OF THE INVENTION

Accordingly, the present invention has been made to solve the above-mentioned problems occurring in the prior arts, and it is an object of the present invention to provide a heat exchanger, which has approximately U-shaped ribs formed on both sides of a body of a side support, thereby preventing a deterioration of heat exchange capacity by reinforcing strength and securing bonding areas of sealing members and stably supporting radiation fins since the ribs press edges of the radiation fins.

To accomplish the above object, according to the present invention, there is provided a heat exchanger including: a pair of header tanks spaced apart from each other by a predetermined interval and arranged at upper and lower parts in parallel to each other; a plurality of tubes combined to both ends of the header tanks in such a way as to fluidically communicate with the header tanks; radiation fins interposed between the tubes; and a pair of side supports mounted at the outermost ends of the tubes and the radiation fins to protect the tubes and the radiation fins, one of the side supports having a body combined to the header tanks and ribs bent at both sides of the body in U-shape to reinforce strength and form bonding surfaces of sealing members and protrudingly formed in an outward direction of the body, ends of the ribs pressing the radiation fins, wherein when a height of the tube is Ht, a height (Hs) of at least one of the side supports satisfies the following formula: $0.8 \times Ht \leqq Hs \leqq 1.35 \times Ht$.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Reference will be now made in detail to the preferred embodiment of the present invention with reference to the attached drawings. In the present invention, description of the same parts and operations as the conventional heat exchanger will be omitted.

Figure 1:
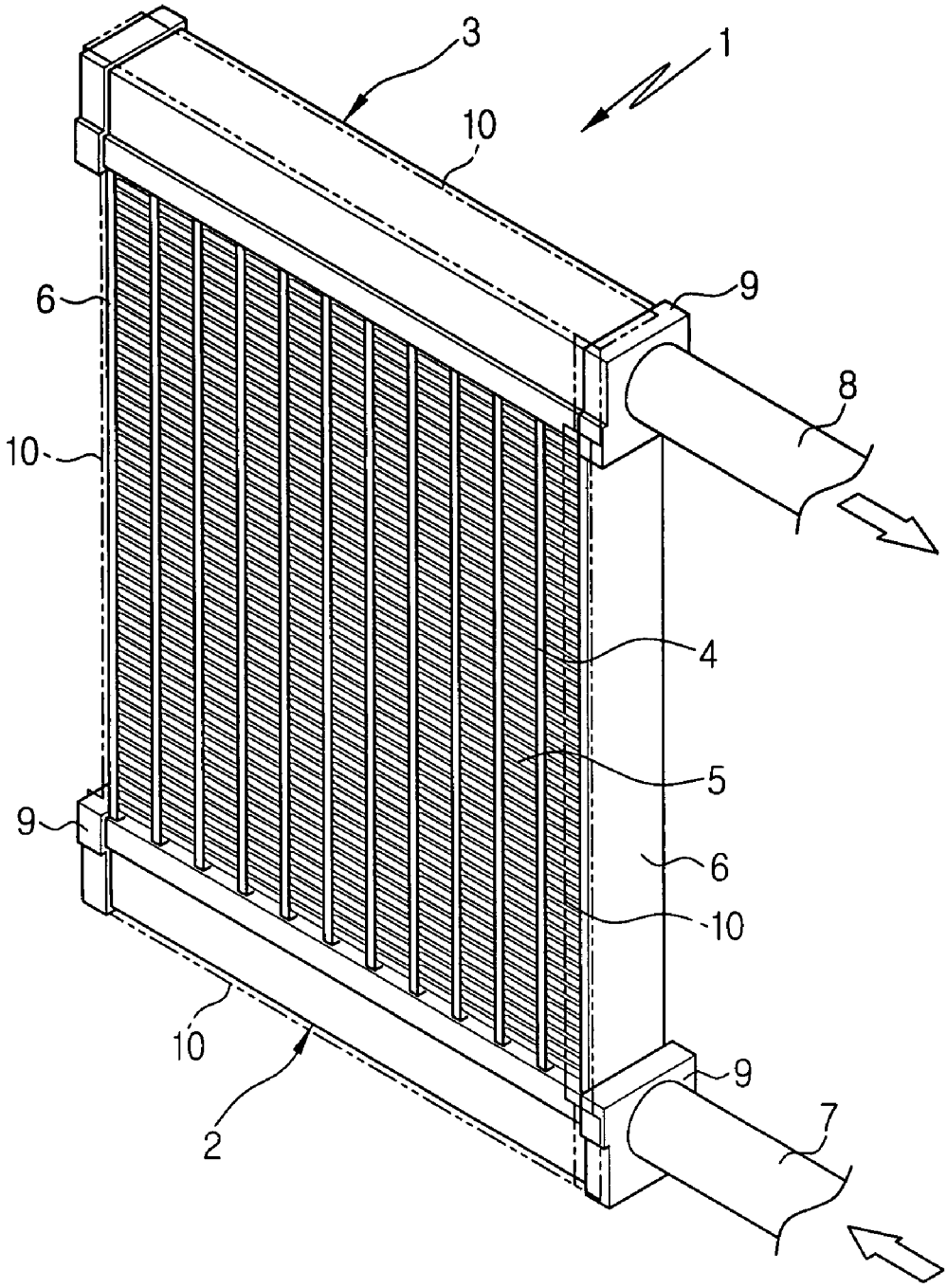
FIG. 1 is a perspective view of a heat exchanger according to a prior art.
Figure 2:
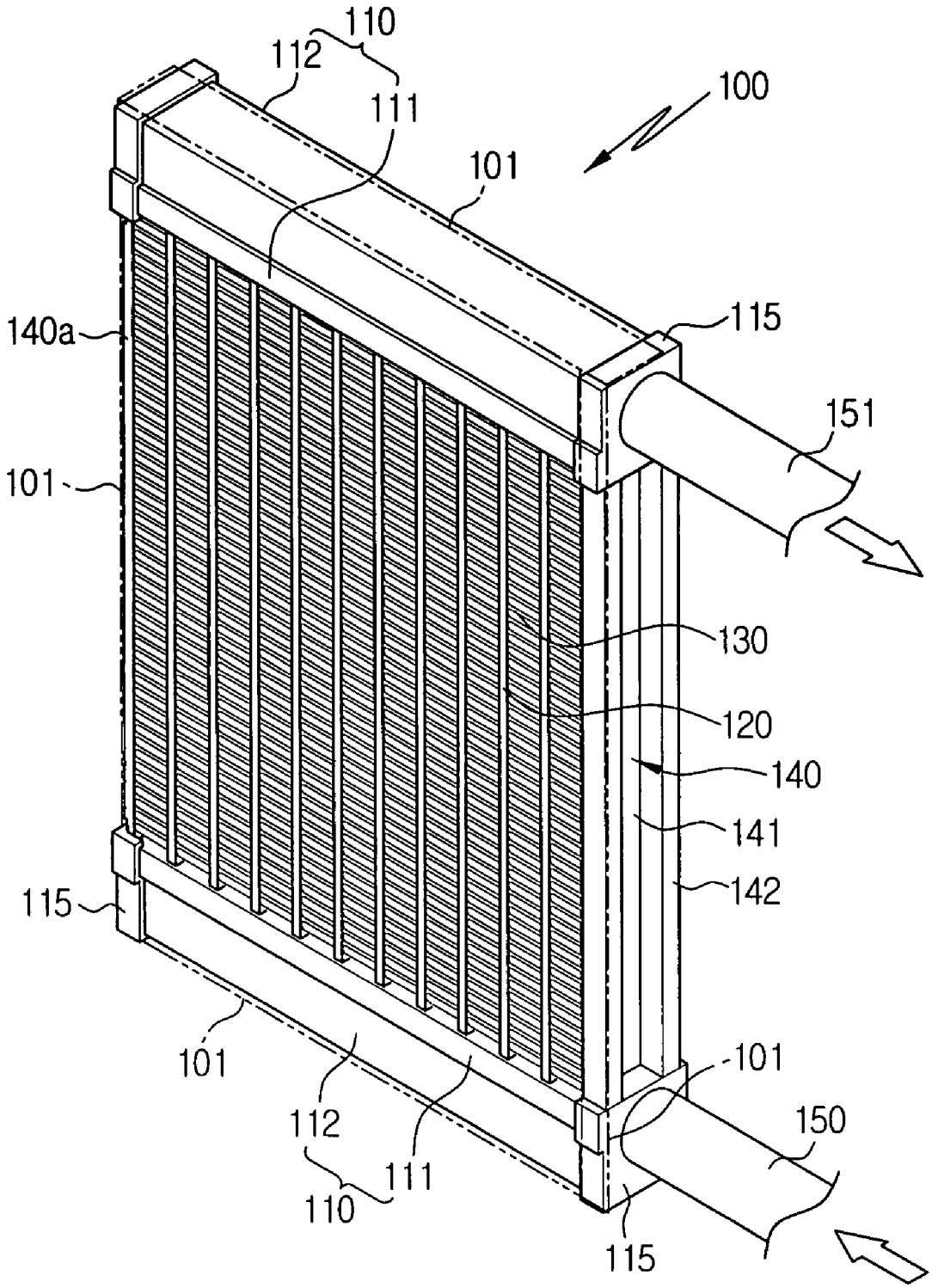
FIG. 2 is a perspective view of a heat exchanger according to the present invention.
Figure 3:
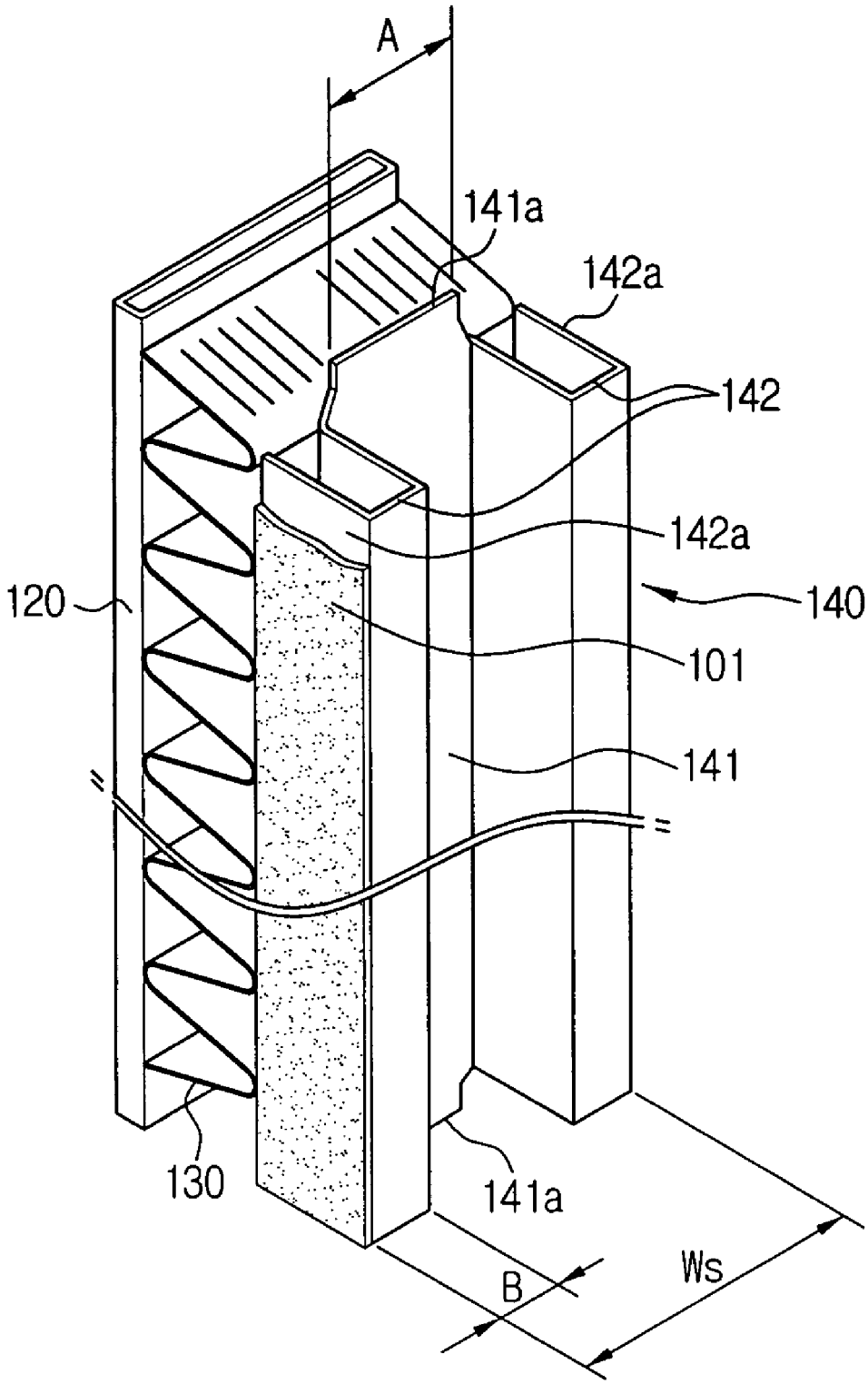
FIG. 3 is a perspective view of a side support of the heat exchanger according to the present invention.
Figure 4:
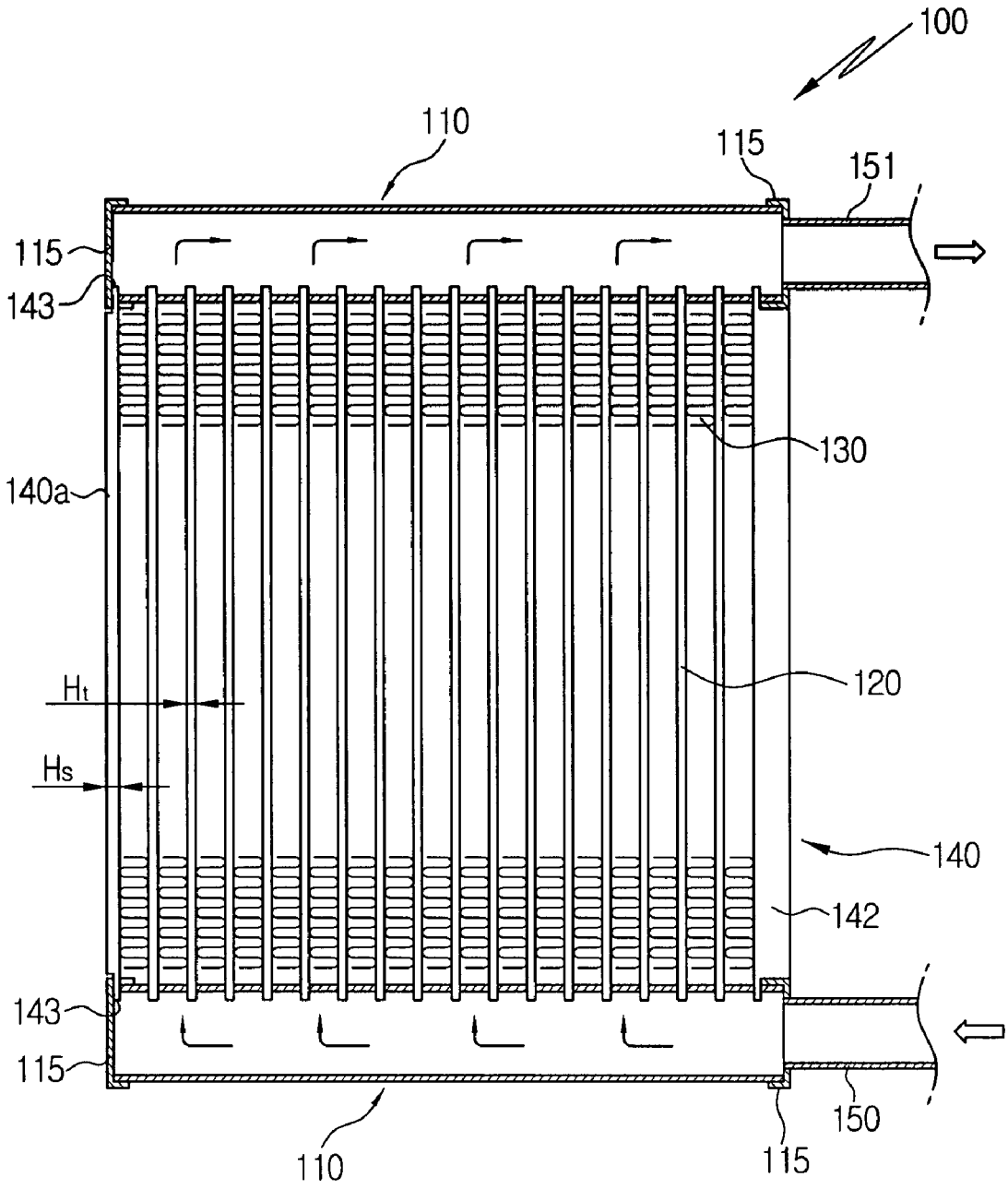
FIG. 4 is a sectional view of the heat exchanger according to the present invention.
Figure 5A:
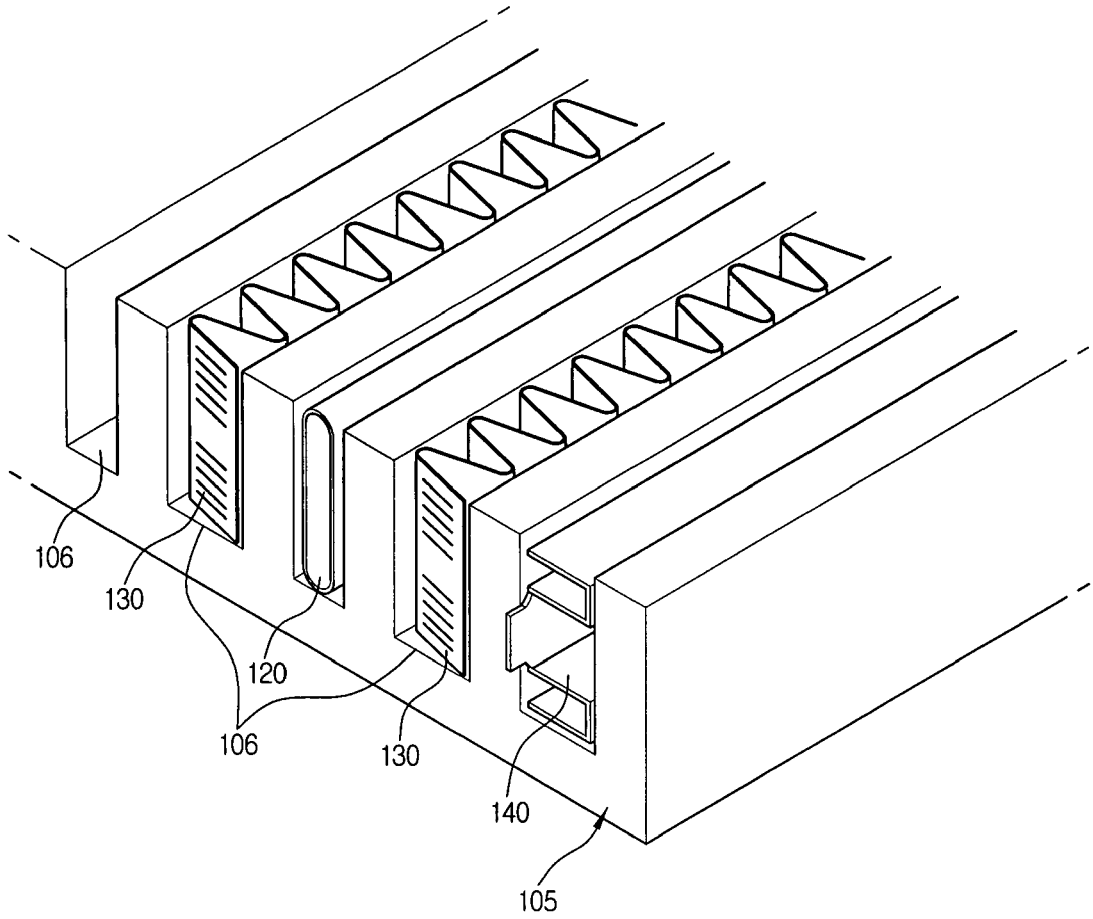
FIG. 5*a* is a perspective view showing a state where the side support, tubes and radiation fins are aligned on a tray to manufacture the heat exchanger according to the present invention.
Figure 5B:
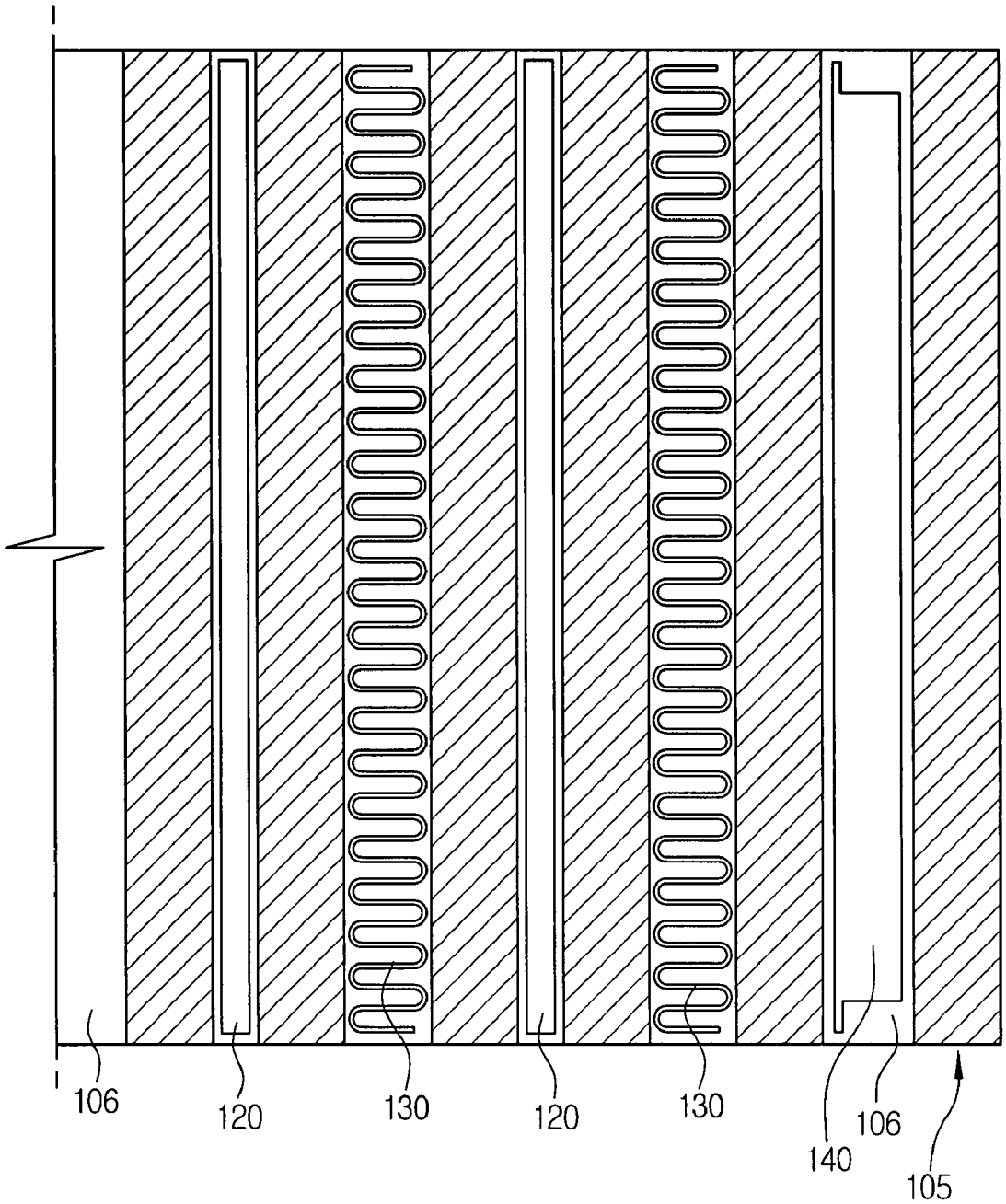
FIG. 5*b* is a plan view showing the state where the side support, the tubes and the radiation fins are aligned on the tray to manufacture the heat exchanger according to the present invention.

FIG. 2 is a perspective view of a heat exchanger according to the present invention, FIG. 3 is a perspective view of a side support of the heat exchanger, FIG. 4 is a sectional view of the heat exchanger, and FIGS. 5*a* and 5*b* are a perspective view and a plan view showing a state where the side support, tubes and radiation fins are aligned on a tray to manufacture the heat exchanger according to the present invention.

As shown in the drawings, the heat exchanger 100 according to the present invention includes: a pair of header tanks 110 spaced apart from each other by a predetermined interval and arranged at upper and lower parts thereof in parallel to each other; a plurality of tubes 120 combined to both ends of the header tanks 110 to be fluidically communicated with the header tanks 110; radiation fins 130 interposed between the tubes 120 to promote heat exchange by widening a heat transfer area; and a pair of side supports 140 and 140*a* mounted at the outermost ends of the tubes 120 and the radiation fins 130 to protect them.

Here, the header tank 100 includes a header 111 having a plurality of tube holes (not shown) to which ends of the tubes 120 are combined, and a tank 112 combined to the header 111 to form a passageway in which heat exchange medium flows.

Ends of the header tanks 110 are sealed by end caps 115.

Moreover, an inlet pipe 150 is mounted at an end portion of one header tank 110 to allowing an introduction of the heat exchange medium, and an outlet pipe 151 is mounted at an end portion of the other header tank 110 to allowing a discharge of the heat exchange medium.

That is, the inlet pipe 150 is horizontally combined to the end cap 115 combined to the end portion of the one header tank 110, and the outlet pipe 151 is horizontally combined to the end cap 115 combined to the end portion of the other header tank 110.

The above components are bonded mutually by brazing in a temporarily assembled state.

Furthermore, the side support 140 located on the inlet and outlet pipes side includes: a flat-plate type body 141 having inserted portions 141*a* protrudingly formed at both end portions thereof to be combined to the header tanks 110; and ribs 142 bent on both sides of the body 141 in multi-stages, end portions of the ribs 142 pressing the radiation fins 130.

That is, since the side supports 140 and 140*a* are manufactured by a roll-forming process, it is difficult to form a strength-reinforcing structure, for combination with the header tank 110 (a plane state is preferable), on the body 141 on which the inserted portions 141*a* are formed. So, in the present invention, the ribs 142 are formed by bending both sides of the body 141 in multi stages, excepting the inserted portions 141*a*, to thereby reinforce strength and secure bonding surfaces 142*a*, to which the sealing members 101 are bonded, formed on the side surfaces of the ribs 142.

It is preferable that the rib 142 is bent in U-shape and protrudes in the outward direction of the body 141 (outward direction of the heat exchanger).

Here, since the ribs 142 bent in the U-shape have a predetermined elasticity and end portions of the ribs press edges of the radiation fins 130 with the predetermined elasticity, the ribs 142 can stably support the radiation fins 130 to thereby prevent movement of the radiation fins 130 during carrying or brazing the heat exchanger 100 after the exchanger 100 is assembled temporarily.

In addition, since the ribs 142 protrude in the outward direction of the body 141, the outer surface of a wider portion of the side support 140 and the outer surface of a wider portion of the end cap 115 mounted on the end portion of the header tank 110 are on the same plane with each other without any tiered portion, so that the sealing members 101 can be easily bonded on the circumference of the heat exchanger 100.

Moreover, since the bonding surfaces 142*a* for the sealing members 101 are secured, the sealing members 101 do not invade an area of the radiation fins 130 even though the sealing members 101 are bonded on the side surfaces of the side support 140, whereby the heat exchanger according to the present invention can prevent a decrease of heat exchange capacity.

Furthermore, when the entire width of the side support 140 is Ws, it is preferable that a width (B) of the rib 142 formed on the body 141 satisfies the following formula, $0.12\times Ws \leqq B \leqq 0.3\times Ws$.

If the width (B) of the rib 142 is larger than $0.3\times Ws$, a bonding strength between the side support 140 and the radiation fin 130 is decreased since a brazed surface in contact with the radiation fin 130 is reduced, but if the width (B) of the rib 142 is smaller than $0.3\times Ws$, strength of the side against the external force is decreased.

In addition, when the entire width of the side support 140 is Ws, it is preferable that a width (A) between the inserted portions 141*a* formed at both end portions of the body 141 satisfies the following formula, $0.35\times Ws \leqq A \leqq 0.6\times Ws$.

If the width (A) of the inserted portion 141*a* is larger than $0.6\times Ws$, strength against the external force is decreased since the width (B) of the rib 142 is relatively reduced, but if the width (A) of the inserted portion 141*a* is smaller than $0.35\times Ws$, a bonding strength between the side support 140 and the header tank 110 is decreased.

As described above, the side support 140 located on the inlet and outlet pipes side has the ribs 142 at both sides of the body 141, but the side support 140*a* located on the opposite side of the inlet and outlet pipes 150 and 151 is in a flat-plate form which has inserted portions 143 formed at both end portions to be combined with the header tanks 110.

Of course, like the side support 140, the side support 140*a* located on the opposite side of the inlet and outlet pipes 150 and 151 may also have the ribs 142. The side supports 140 and 140*a* may adopt one of various structures, such as the structure having the ribs 142 and the flat-plate structure, according to an attached position of the sealing member 101.

In the meantime, it is preferable that the outer surface of the wider portion of the side support 140 located on the opposite side of the inlet and outlet pipes 150 and 151 is coincided with the outer surface of the wider portion of the end cap 115 mounted at the end portion of the header tank 110.

Hereinafter, the side support 140*a* located on the opposite side of the inlet and outlet pipes 150 and 151 will be described.

It is preferable that the outer surface of the wider portion of the side support 140*a* is coincided with the outer surface of the wider portion of the end cap 115 mounted at the end portion of the header tank 110. That is, if a tiered portion is formed between the outer surface of the wider portion of the end cap 115 and the outer surface of the wider portion of the side support 140*a*, when the heat exchanger 100 is inserted and installed in the air-conditioning case, since an air leakage may occur between the inner wall surface of an air-conditioning case (not shown) and the side support 140*a*, the outer surface of the wider portion of the end cap 115 mounted at the end portion of the header tank 110 and the outer surface of the wider portion of the side support 140*a* are coincided with each other without any tiered portion.

Of course, without regard to the flat-plate type side support 140*a* or the side support 140*a* having the reinforcing ribs, the outer surface of the wider portion of the side support 140*a* must be coincided with the outer surface of the wider portion of the end cap 115 without the tiered portion.

Here, when a height of the tube 120 is Ht, it is preferable that a height (Hs) of the side support 140*a* satisfies the following formula, $0.8\times Ht \leqq Hs \leqq 1.35\times Ht$. The above formula can be applied not only to the height (Hs) of the side support 140*a* located on the opposite side of the inlet and outlet pipes 150 and 151 but also to a height of the side support 140 located on the inlet and outlet pipes side.

For your reference, as shown in FIGS. 5*a* and 5*b*, the tubes 120 and the radiation fins 130 are accumulated on a tray 105 in turns to assemble the heat exchanger 100, namely, an assembly process is carried out after the radiation fins 130 and the tubes 120 are put on a plurality of grooves 106, which are formed on the tray 105, in order on the basis of one side support 140.

In this instance, the radiation fins 130 and the tubes 120 are aligned based on the side support 140, which is located on the inlet and outlet pipes side and has the ribs 142 of a predetermined height. Meanwhile, the side support 140*a* finally aligned on the opposite side has the height (Hs) similar with the height (Ht) of the tube 120 ($0.8\times Ht \leqq Hs \leqq 1.35\times Ht$) to vary the number of arrays of the tubes 120.

That is, since the height (Hs) of the side support 140*a* is similar with the height (Ht) of the tube 120, the tray 105 can be used in common even when another heat exchanger 100 of different number of arrays of the tubes 120 is manufactured.

If the height (Hs) of the finally aligned side support 140*a* (located on the opposite side of the inlet and outlet pipes) is larger than $1.35\times Ht$, when the side support 140*a* is aligned on the tray 105 used for manufacturing the heat exchanger 100 of the different number of arrays of the tubes 120, the side support 140*a* of the height (Hs) larger than the groove 106 of the tray 105 cannot be inserted thereto.

On the contrary, if the height (Hs) of the side support 140*a* aligned finally is smaller than $0.8\times Ht$, since a width of the groove 106 of the tray 105 is larger than the height (Hs) of the side support 140*a*, the side support 140*a* cannot stand.

So, the height (Hs) of the side support 140*a* located on the opposite side of the inlet and outlet pipes is similar with the height (Ht) of the tube 120 ($0.8\times Ht \leqq Hs \leqq 1.35\times Ht$) to vary the number of arrays of the tubes 120 when the heat exchanger 100 is manufactured, so that the tray 105 can be used in common.

As described above, the side support 140 located on the inlet and outlet pipes side can reinforce strength and secure the bonding surfaces of the sealing members 101 by virtue of the ribs 142, whereby the heat exchanger 100 according to the present invention can solve the problem in that the heat exchange capacity is deteriorated since the sealing members 10 (in the prior art) invade the area of the radiation fins 5 (in the prior art) and hide the radiation fins 5.

Furthermore, the outer surface of the wider portion of the side support 140*a* located on the opposite side of the inlet and outlet pipes is coincided with the outer surface of the wider portion of the end cap 115 mounted at the end portion of the header tank 110 to thereby keep sealability, and the heat exchanger can reinforce strength if the ribs are formed on also the side support 140*a*.

Meanwhile, the side support 140 located on the inlet and outlet pipes side reinforces strength by the ribs 142 formed at both sides of the body 141, and so, a thickness of the heat exchanger can be reduced through the above improved structure.

As described above, the structure that the ribs 142 of the U-shape are formed at both sides of the side support 140 is applied to a heater core of the heat exchanger 100, but the present invention can be applied to all heat exchangers, such as a radiator, a condenser, an evaporator, and so on, in the same configuration and method without being restricted to the above to obtain the same effects.

The present invention can reinforce strength and secure the areas to bond the sealing members thereto by forming the approximately U-shaped ribs at both sides of the side support, allow the sealing members to be easily bonded, and stably support the radiation fins since ribs press the edges of the radiation fins.

In addition, the present invention can prevent deterioration of the heat exchange capacity since the bonding areas of the sealing members are secured by the ribs and the sealing members do not invade the area of the radiation fins when the sealing members are bonded on the side surfaces of the side support.

Moreover, the present invention can reduce the thickness of material since the strength of the side support is reinforced by the ribs.

Furthermore, the present invention can keep sealability since the outer surface of the wider portion of the side support located on the opposite side of the inlet and outlet pipes is coincided with the outer surface of the wider portion of the end cap mounted at the end portion of the header tank without any tiered portion.

While the present invention has been described with reference to the particular illustrative embodiment, it is not to be restricted by the embodiment but only by the appended claims. It is to be appreciated that those skilled in the art can change or modify the embodiment without departing from the scope and spirit of the present invention.

What is claimed is:

1. A heat exchanger comprising:

a pair of header tanks spaced apart from each other by a predetermined interval and arranged at upper and lower parts parallel to each other;

a plurality of tubes combined to both ends of the header tanks in such a way as to fluidically communicate with the header tanks;

radiation fins interposed between the tubes; and a pair of side supports mounted at the outermost ends of the tubes and the radiation fins to protect the tubes and radiation fins, one of the side supports having a body combined to the header tanks and ribs bent at both sides of the body in U-shape to reinforce strength and form bonding surfaces of sealing members and the ribs being protrudingly formed in an outward direction of the body;

wherein when a width of at least one of the side supports is Ws, a width (B) of the ribs formed on the body satisfies the following formula in order for the ribs to have inner space in the U-shape thereof:

$$0.12\times Ws \leqq B \leqq 0.3\times Ws; \text{ and}$$

wherein outside walls of the U-shaped ribs are formed as free ends and wherein the edges of the free ends of outside walls of the U-shaped ribs press the end of the edges of the radiation fins.

2. The heat exchanger according to claim 1, wherein the body of the side support has insertion portions formed at both end portions thereof to be inserted and combined to the header tanks.

3. The heat exchanger according to claim 1, wherein at least one of the side supports has an outer surface with a portion wider than another portion, which is coincided with the outer surface of a wider portion of an end cap mounted at an end of the header tank.

4. The heat exchanger according to claim 1, wherein when a width of at least one of the side supports is Ws, a width (A) of inserted portions formed at both end portions of the body satisfies the following formula:

$$0.35\times Ws \leqq A \leqq 0.6\times Ws.$$

5. The heat exchanger according to claim 1, wherein when a height of the tube is Ht, a height (Hs) of at least one of the side supports satisfies the following formula:

$$0.8\times Ht \leqq Hs \leqq 1.35\times Ht.$$

6. The heat exchanger of claim 1, wherein the outer ends of the ribs press the end of the edges of the radiation fins with predetermined elasticity.

* * * * *